United States Patent [19]

Thompson

[11] Patent Number: 4,942,712

[45] Date of Patent: Jul. 24, 1990

[54] ROOF COVERING

[76] Inventor: Peter B. Thompson, Nordrach, Blagdon, Bristol BS18 6XW, United Kingdom

[21] Appl. No.: 223,072

[22] PCT Filed: Nov. 24, 1987

[86] PCT No.: PCT/GB87/00838

§ 371 Date: Jul. 19, 1988

§ 102(e) Date: Jul. 19, 1988

[87] PCT Pub. No.: WO88/03981

PCT Pub. Date: Jun. 2, 1988

[30] Foreign Application Priority Data

Nov. 24, 1986 [GB] United Kingdom ..... 8628021

[51] Int. Cl.[5] ..... E04D 3/32; E04D 3/30; E04C 2/32

[52] U.S. Cl. ..... 52/506; 52/417; 52/573; 52/630; 52/537; 52/747; 52/748

[58] Field of Search ..... 52/630, 523, 537, 521, 52/200, 748, 506, 747, 417; D25/138, 157, 158, 159, 156

[56] References Cited

U.S. PATENT DOCUMENTS

| | | | |
|---|---|---|---|
| 496,478 | 5/1893 | Grafton | 52/537 |
| 2,703,060 | 3/1955 | Kiefer | 52/200 |
| 2,918,023 | 12/1959 | Bettcher | 52/81 |
| 3,299,598 | 1/1967 | Alleaume | 52/573 |
| 3,362,118 | 1/1968 | Brunner | 52/573 |
| 3,503,839 | 3/1970 | Breitwieser | 428/179 |
| 3,663,349 | 5/1972 | Venturino | 428/179 |
| 3,950,585 | 4/1976 | Hale | 428/179 |
| 3,994,693 | 11/1976 | Parmley | 52/573 |
| 4,018,016 | 4/1977 | Zale | 52/200 |
| 4,080,763 | 3/1978 | Naidus | 52/200 |
| 4,146,666 | 3/1979 | Houtlosser | 52/573 |

*Primary Examiner*—John E. Murtagh

*Attorney, Agent, or Firm*—Rines and Rines Shapiro and Shapiro

[57] ABSTRACT

A roof covering suitable for use on flat or shallow angle roofs is of sheet-like form and has at least one raised region (7) in the sheet, the raised region (7) merging into undulations (5) of the border (2) surrounding the raised region (7). The shape of the covering enables differential expansion and or contraction effects between the covering and a substrate (3) on which it is laid to be accommodated.

20 Claims, 3 Drawing Sheets

ROOF COVERING

This invention relates to roof coverings and, in particular, to roof coverings which are suitable for use on flat or shallow angle roofs (that is, roofs which are horizontal or slope at a shallow angle, typically less than 15°, to the horizontal).

The invention is concerned, more especially, with roof coverings of sheet-like form which are intended to be laid on a substantially continuous substrate, for example a roofing deck, to provide a waterproof skin to a roof. It is known to produce roof coverings in the form of panels which, in use, are secured at their edges to the substrate either directly or via a layer of insulating material, for example a rigid foam. The panels are normally made of a plastics material, often reinforced with fiber and typically have a very high coefficient of expansion and a comparatively low elongation at break particularly at temperatures below 10° C. A typical general purpose polyester resin reinforced with chopped strand glass mat would have an elongation at break of less than 0.2% at 10° C. Failure to provide some means of accommodating expansion and contraction of the panels relative to the substrate often results in cracking of a portion of the panel, particularly when laid over large roofs, causing the roof to leak.

Problems due to expansion and contraction of roof coverings are also encountered when the coverings are formed from other materials, for example metal or asphalt.

The present invention provides a roof covering suitable for use on flat or shallow angle roofs, the covering being of sheet-like form and having at least one raised region in the sheet, the raised region merging into undulations at the border surrounding the raised region.

The undulating border and raised region together provide a means by which the covering can, by changing its shape, accommodate expansion or contraction. For example, if the temperature of the covering increases without there being a corresponding expansion of the substrate, the undulations will become more severe and the raised region rise up further. Conversely, if the temperature of the covering reduces without there being a corresponding contraction of the substrate, the undulations will become less severe and the raised region will shrink in size.

The raised region preferably has a curved configuration in cross-section and is more preferably of essentially inverted-dish shape. "Dish shape" as used herein is not limited to shapes which are of part-circular cross-section. Alternative shapes may be used, including for example, a raised region generally dish-shaped but having a depressed central portion or a flattened central portion, and a raised region comprising a series of ridges and depressions each of which surrounds a common point. Regions having a depressed central portion or ridges and depressions are less advantageous in that water may collect in the depressed portion or between the ridges as the case may be; raised regions having a flattened portion are less advantageous in that the flattened central portion has reduced efficiency in accommodating expansion or contraction by altering its shape.

The covering may be in the form of a panel.

In an embodiment of the invention, the covering comprises a plurality of raised regions of relatively large subtended volume, each of which merges generally downwardly into a surrounding undulating border made up of a series of smaller subtended volume undulations. There may be a plurality of securing points spaced apart around the border of the, or each, raised region, or of a group of raised regions.

Advantageously, the length and width of the covering measured along undulating edges and following the surface of the covering are approximately the same as the length and width respectively of the covering measured across the centers of the larger volume raised region or the centres of the raised regions following the surface of the covering. Most advantageously, for a unit length of the covering in any direction the distance measured in the direction of that unit length, following the surface of the covering, will be the same, irrespective of the direction.

Preferably, the raised region and the undulations are so formed that a uniform flattening of their shapes will occur when stretching forces are applied at the edges of the covering.

The border of the covering will usually comprise a continuous series of undulations, and there may be a single undulation only between successive securing points.

The covering may be formed from a plastics or polymer material, which may incorporate reinforcement.

A plurality of roofing panels constructed in accordance with the invention can be used to form a covering for a roof structure, the panels being arranged side by side on a substantially continuous substrate, with the undulations of adjacent panels aligned, and being secured to the substrate.

By way of example, embodiments of the invention will now be described with reference to the accompanying drawings, in which.

Figure 1:
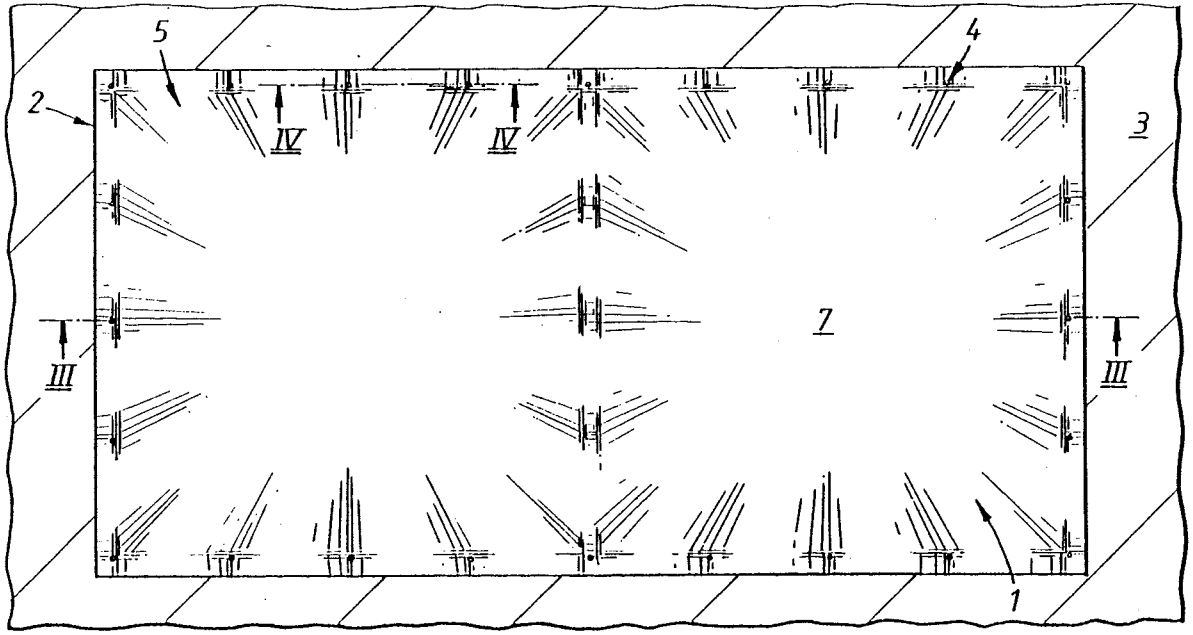
FIG. 1 is a plan view of a roofing panel secured to a supporting substrate.
Figure 3:
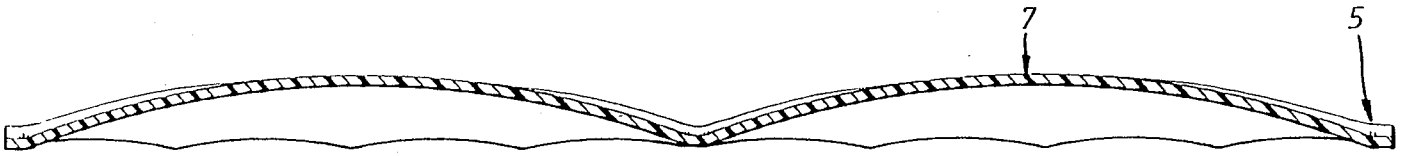
FIG. 3 is a sectional view, on an enlarged scale, on the line III—III of FIG. 1.

The panel 1 shown in FIG. 1 is made in one piece from a plastics material, for example a polyester resin, reinforced with fibers for example glass fibers. The panel is of rectangular shape and has two raised regions 7, which in this example are of inverted-dish shape, merging with undulating borders 2. A can be seen from FIG. 1, each border is formed by a portion of the covering which undulates along the length of that border. Typically, the length of the panel is 8 ft (2.44 m) and the width of the panel is 4 ft (1.22 m), each raised region with merging undulating borders being approximately 4 ft×4ft (1.22 m×1.22 m).

The panel 1, along with a plurality of other similar panels (not shown), is laid on a continuous flat substrate 3. In this case, the substrate 3 is a conventional roofing deck, but it could be any other suitable even surface, for example a layer of insulating material covering a roofing deck. During or following manufacture of the panel it may be convenient to secure by adhesive means a layer of insulating material to the underside of the panel.

The panel is secured to the roofing deck 3 at points indicated by the reference 4 in FIGS. 1 and 4 to 6. These points 4 are spaced apart around the border 2 of the panel, and between each pair of successive points 4 there is a single undulation 5 in the border 2, rising up from the roofing deck 3. The bottoms of the undulations 5 are located in a common plane such that at each of the points 4 the border 2 is in contact with the roofing deck.

The raised regions 7 in the center portions of the panel also rise up from the roofing deck and have undulating perimeters which merge smoothly with the undulations 5.

The panel is secured to the roofing deck, at the points 4 (FIGS. 1 and 4 to 6), by any suitable means 6, for example nails, screws, drill-screws, cavity or plug fastenings, resilient or flexible fastenings or an adhesive. Panels are laid side-by-side or end-to-end on the roofing deck with the undulations 5 aligned. The panels may be laid either over-lapping or with edges abutting or even slightly spaced and may have strips of suitable material under the joints to improve rigidity. When the panels have been secured to the roofing deck, the joints between adjacent panels are finished in any suitable way, for example by coating with a suitably catalyzed liquid polyester resin and reinforced with a suitable fiber. The coating procedure may be repeated if desired to achieve a laminate. Finally, a layer of polyester gel or other suitable finish coat may be applied to the coated joints and/or the panels. Preformed edging pieces preferably of undulating construction may be fabricated and joined to the panels by the same seaming method.

Figure 5:
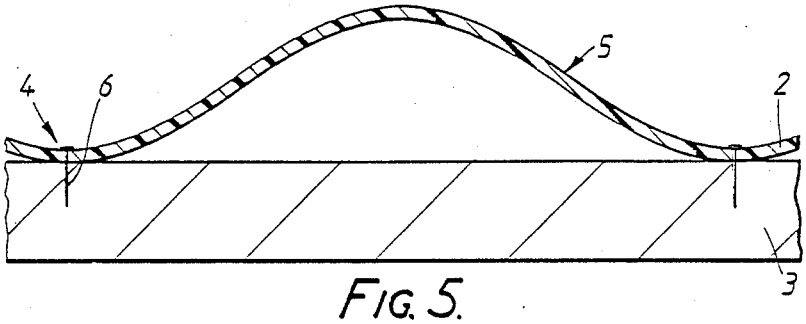
FIGS. 5 and 6 are similar to FIG. 4 but illustrate changes that can occur in the shape of the panel.
Figure 6:
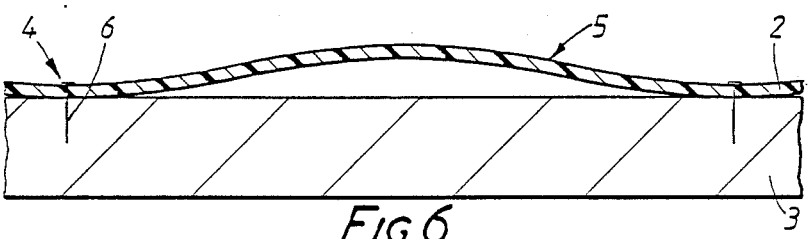

If, in the completed roof structure, any part of a panel expands or contracts relative to the roofing deck 3, for example as a result of a change in temperature, the expansion or contraction results .in a rise or fall of one or more of the undulations 5 and/or the raised regions 7. FIGS. 5 and 6 show, respectively, how the undulations 5 increase and decrease in height when the panel border 2 expands and contracts. It will be understood that a corresponding increase or decrease in height will occur, as required, in the raised regions 7. In each case, expansion or contraction of the panel, or part of the panel, is accommodated without damage to the panel or supporting roof structure in the region of the fastening means 6. In the absence of the undulations 5 and raised regions 7, on the other hand, there is a substantial risk of breakage or cracking occurring around the fastening means 6 or the seamed area or over other portions of the panel, particularly where panels are used to cover large roofing areas.

The height and length of the undulations 5 and the height and extent of the raised regions 7 are selected having regard to the coefficient of expansion of the panel material and to the range of temperatures which the panel is likely to encounter. Preferably, the dimensions of the undulations 5 and the raised regions 7 are such that they are able, through a change in height, to accommodate expansion or contraction of the panel over a temperature range of 100° C. for example from −30° C. to +70° C. at the lower end of this range, the undulations and raised regions may shrink substantially and in extreme circumstances become virtually flat. For an 8 ft×4 ft (2.44 m×1.22 m) panel with two raised regions, the length a of the undulations is likely to be within the range 15 mm to 600 mm, especially 25 mm to 500 mm, and the height b at the highest point is likely to be within the range 1 mm to 40 mm, especially 5 mm to 30 mm, in its unstressed form. The height of each raised region at its highest point is likely to be less than 200 mm, especially less than 150 mm, in its unstressed form. The height of each raised region at its highest point is likely to be not less than 10 mm in its unstressed form.

In one example, the panel is a 25% glass to resin laminate having a coefficient of expansion of approximately $30\times10^{-6}$ per °C. (the resin being a polyester resin of the type E6357 made by Cray Valley Products Ltd). The length a of the undulations is, typically, 270 mm and the height b is, typically, 17 mm while the height of each raised region at its highest point is, typically, 50 mm.

Figure 7:
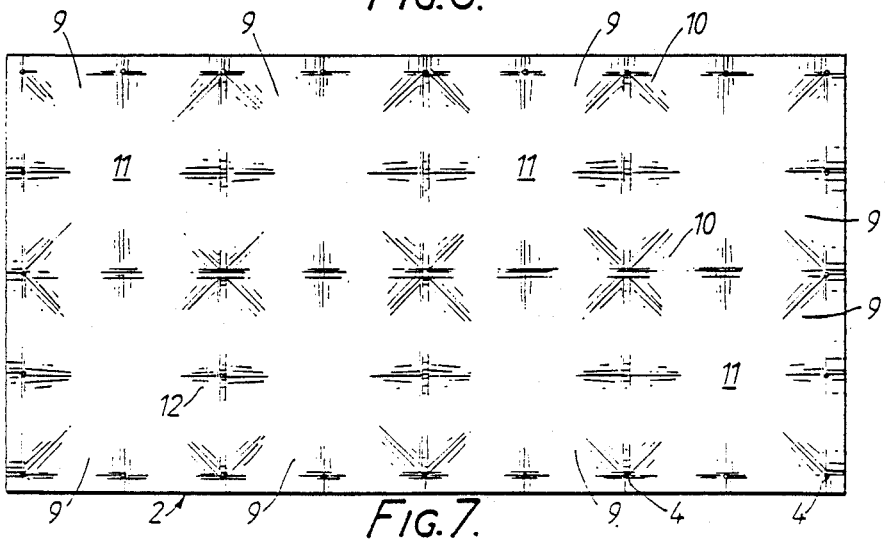
FIG. 7 is a plan view of a roofing panel of another construction.

Another form of panel is shown in FIG. 7. This panel is, overall, of the same size as that shown in FIGS. 1 and 2 but is subdivided into eight portions 9, each of which has an undulating border 10 and a raised center region 11. The undulations in the borders 10 are similar to those in the panel of FIGS. 1 and 2 but each of the raised regions 11 is, clearly, smaller than the raised regions 7. In the panel shown in FIG. 7, each of the portions 9 is a 2 ft×2 ft (610 mm×610 mm) square and the height of the raised region 11 is, typically 25 mm. The panel has additional securing points 12 in the undulations which subdivide the panel and these can, if required, be utilized in addition to the securing points 4 around the edge of the panel. The additional securing points 12 are, however, not essential and need not normally be used.

Figure 2:
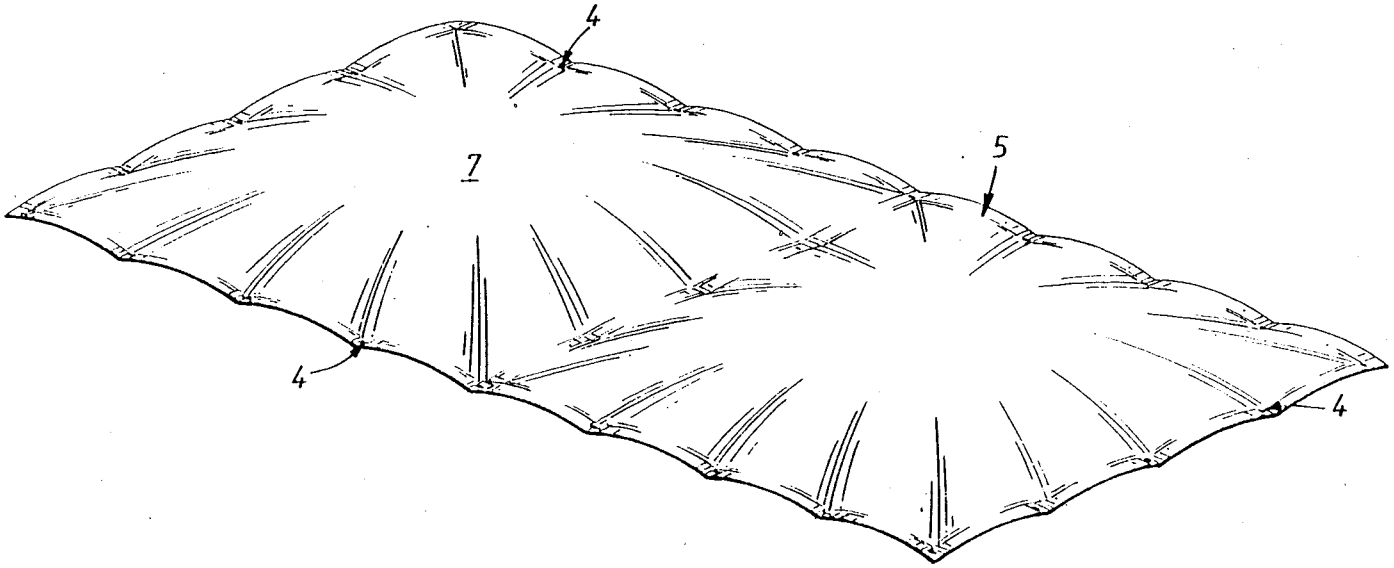
FIG. 2 is a perspective view of the panel of FIG. 1.
Figure 4:
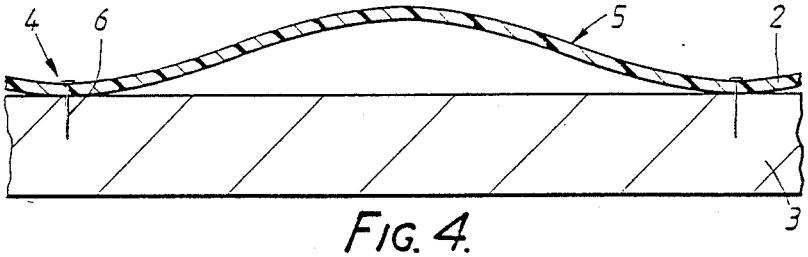
FIG. 4 is a sectional view, on an enlarged scale, on the line IV—IV of FIG. 1.

The configuration of raised regions and undulations shown in the panels of FIGS. 1 and 2 or FIG. 7 can also be produced, in repeat, on a sheet or, provided that the panels are sufficiently thin, on a continuous roll of roof covering material. The sheet would have an undulating border similar to that provided on the panels. In the case of a continuous roll, which would be cut to size as required, the roll would be cut along a line of undulations.

From the theoretical viewpoint, a preferred arrangement is for the length and width of the panel measured along undulating edges and following the surface of the covering to be approximately the same as the length and width of the panel measured in other more central regions following the surface of the covering. In the most preferred arrangement, for a unit length of the covering taken in any direction, the distance measured along the direction of the unit length following the surface of the covering will be the same irrespective of the direction. In such a case, changes of temperature will be accommodated by reasonably uniform alteration of the panel shape over the entire panel. This is most easily achieved in the case where the undulating edges of each raised region are of equal length; arrangements of this kind are shown in FIGS. 1 and 7.

Although FIGS. 1 and 7 each illustrate a highly efficient design in dealing with expansion and contraction in any given line across a panel, it is quite acceptable not to satisfy the most preferred conditions outlined in the paragraph immediately above. It is also acceptable to modify the raised region of the panel such that it is not a simple dish-shape, for example by providing a disc-shaped depression in its center, by providing a series of concentric circular ridges and depressions, or by flattening the dish shape.

It will be understood that the shape of the undulations 5, 10 in the borders 2 of the panels described above could be varied and also that there could be more than one undulation between successive fixing points 4.

It will also be understood that, although the panels shown in FIGS. 1 and 2 and FIG. 7 are of rectangular shape, this is not essential, and the undulating borders 2 and raised regions 7, 11 could be incorporated in panels of other shapes, for example hexagonal or triangular.

A panel as shown in FIGS. 1 and 2 or FIG. 7 can be made using a mold having the same dimensions, undulations and raised region(s) as those required for the finished panel. The mold surface is covered with the suitably catalyzed liquid polyester resin, by means of a brush or by pouring, spraying or any other convenient method. The catalyzed resin is overlaid with a glass reinforcing layer before it has cured and the sequence is then repeated as required. A method of this type, and subsequent use of the panels so produced, are described in the following example:

An aluminium mold surface is coated with a preaccelerated general purpose polyester resin, for example a mixture of E6357 or Quickcure 20 (trade mark) made by Cray Valley Products Ltd. and 1.5% of methyl ethyl ketone peroxide (MEKP). A reinforcing layer of 300 $gm^{-2}$ (grams per square meter) chopped glass strand mat is laid over the resin-covered mold and rolled with a 4 inch consolidating roller to remove trapped air. A further coating of polyester resin is then applied to the mat-covered mold and is also consolidated under the roller. A second reinforcing layer of 300 $gm^{-2}$ chopped glass strand mat is then applied together with a further layer of polymer mixture, both layers again being consolidated using the roller. The molding is then allowed to cure at ambient temperature or, preferably, is heat cured at 70° C. for 30 minutes. The molded panel is then removed, and it may be coated in all areas except the border with a finish coat to improve longevity or impart color. Special finish coats comprising, for example, sand and adhesive may also be applied and thoroughly dried or cured.

The panels are then laid side-by-side or end-to-end on a suitably prepared roof deck and are fastened to the deck at the securing points 4 by means of screws or nails (or other fasteners suited to the particular deck) or by means of an adhesive. Such fasteners or adhesives must be in sufficient numbers or quantities and of such a type as to conform to applicable wind uplift requirements. The panels are laid with an edge of one panel directly adjoining the corresponding edge of the adjacent panel as far as is practicable. The edges of the panels are next seamed by overlaying with a coating of E6357 or Quickcure 20 resin to which a suitable quantity of curing agent such as MEKP has been added and thoroughly mixed in. A suitable quantity of MEKP would be 1% to 3% depending on ambient temperature at application. Higher temperatures require lower quantities of MEKP and coversely, lower temperatures require higher quantities. Before the applied mixture of resin and MEKP is allowed to cure, a strip of pre-cut 450 $gm^{-2}$ chopped glass strand mat is laid evenly over the joint, covering approximately 2" (2 inches) on either side. A further coat of resin and MEKP mixture is then applied and consolidated using a bristle brush or a small 3" or 4" roller. After the resin has cured or partially cured, a final topcoat layer may be applied and blended in with the top coat of the panel to produce a uniform finish.

It will be understood that the panel used in the method of this example could also be produced using a mold of the reverse shape and applying the coatings in the reverse order.

Alternatively, a panel can be made by coating the mold with a liquid compound comprising the suitably catalyzed polyester resin and chopped glassfibers. When the coating is partially cured, or cured and hardened, further layers of the liquid compound can be applied as required.

Alternatively, a panel can be manufactured by placing a strip of sheet molding compound (SMC), comprising sheet molding resin, filler, chopped strand reinforcement, suitable accelerators and curing agent, in a heated high pressure mold in which the molding compound is simultaneously heated and compressed to form a panel. After removal from the mold, the panel may be top coated if required. The dough molding compound (DMC) method, similar to SMC but using a "dough" containing reinforcing fibers and catalyzed resin, may also be used. These methods are capable of automation or semi-automation.

Although in the above example the use of a high pressure mold is employed, the actual pressure required to form the sheet to the desired shape is relatively low.

Other suitable molding techniques including, for example, cold press molding, vacuum molding and resin injection could be used to manufacture the panels.

The panels shown in FIGS. 1 and 2 and FIG. 7 can be manufactured from any suitable plastics or polymer material which may be reinforced if required. Suitable materials preferably comprise polyesters, epoxy/amines or epoxy/polyamides. Other examples of suitable plastics or polymer materials which may be used in accordance with the invention are materials comprising one or more of the following: phenolic resins, acrylic polymers, acrylic copolymers, polyvinyl chloride, polyvinyl chloride copolymers, nylons, rubber compounds, polystyrenes, styrene copolymers, polyurethanes, polyethylenes, polypropylenes, polyvinyl acetate, polyvinyl acetate copolymers. Derivatives of the materials specified above may also be used. Suitable reinforcing materials may comprise fibers or strands, which may be in the form of a twisted or woven strand material, for example mesh, matting or needled material. Materials suitable for use as reinforcing material are, for example, plywood, wood veneer, and fibers of glass, metal, polymers, (such as polyester, nylon, polyethylene, polypropylene and their derivatives), and carbon.

Alternatively, the panels could be formed of metal, for example copper, or semi-rigid natural materials, for example wood using suitable forming processes.

I claim:

1. A roof covering suitable for use on flat or shallow angle roofs, the covering being in the form of a sheet having means for accommodating substantial expansion and contraction of the sheet along its plane dimensions, said means comprising at least one preformed raised deformable intermediate region of the sheet having a predetermined subtended volume and merging curvedly downwardly over upwardly convex surface portions of the sheet directly into pluralities of preformed smooth deformable undulations surrounding the raised region, with each undulation being of subtended volume small compared with said predetermined volume of the raised region, and with the lower points of at least some of the undulations being arranged to rest upon and to be secured to a substantially planar roof substrate.

2. A covering as claimed in claim 1 in which the raised region is of essentially inverted-dish shape.

3. A covering as claimed in claim 1, wherein said expansion and contraction accommodating means includes a plurality of said preformed raised regions each merging into corresponding surrounding pluralities of preformed smooth deformable undulations as aforesaid.

4. A covering as claimed in claim 1, wherein the raised region and the undulations are dimensioned such that a uniform flattening of their shapes will occur when stretching forces are applied at edges of the sheet.

5. A covering as claimed in claim 1, in which the length of each undulation is within the range of from 15 mm to 600 mm.

6. A covering as claimed in claim 1, in which the height of each undulation, at its highest point, is within the range of from 1 mm to 40 mm.

7. A covering as claimed in claim 1, in which the height of each raised region, at its highest point, is not less than 10 mm.

8. A covering as claimed in claim 1, in which the sheet is made from plastic.

9. A covering as claimed in claim 8, in which the plastic comprises at least one substance selected from the group consisting of polyesters, epoxy/amines, epoxy/polyamides, phenolics, vinylated polymers, polystyrenes, nylons, styrene copolymers, acrylic polymers, acrylic copolymers, polyurethanes, polyethylenes and polypropylenes.

10. A covering as claimed in claim 8, in which the plastic incorporates reinforcement.

11. A covering as claimed in claim 10, in which the reinforcement comprises one of fibers and strands.

12. A covering as claimed in claim 10, in which the reinforcement includes reinforcement selected from the group consisting of chopped fibers, chopped strands, twisted strand material, and woven strand material.

13. A covering as claimed in claim 10, in which the reinforcement includes a material selected from the group consisting of glass, metal, carbon and plastics.

14. A covering as claimed in claim 13, in which the plastics are selected from the group consisting of polyesters, nylons, acrylics, polyethylenes and polypropylenes.

15. A covering as claimed in claim 1, in which the sheet is formed from one of metal and wood.

16. A covering as claimed in claim 1, in which the lower points of the undulations are located in a common plane.

17. A covering as claimed in claim 1, the sheet being in the form of a panel.

18. A roof structure comprising a plurality of sheets according to claim 1 arranged side-by-side and each having the lower points of at least some of its undulations secured to the substrate.

19. A roof structure as claimed in claim 18, wherein the undulations of adjacent panels are aligned.

20. A method of smoothly accommodating for differential thermal expansion and contraction effects between a substantially planar roof substrate and a sheet-like covering secured thereto, comprising the steps of providing a sheet having at least one preformed raised deformable intermediate region of predetermined subtended volume and merging smoothly curvedly downwardly over upwardly convex surface portions of the sheet directly into surrounding pluralities of preformed smooth deformable undulations each of subtended volume small compared with said predetermined volume; placing the sheet on the substrate such that the lower points of the undulations lie in the plane of the substrate; and securing the lower points of at least some of the undulations to the substrate, such that the raised region and surrounding undulations may deform to accommodate differential thermal expansion and contraction effects between the sheet and the substrate along the plane dimensions of the sheet.

* * * * *